US008807695B1

(12) United States Patent
Mantell et al.

(10) Patent No.: US 8,807,695 B1
(45) Date of Patent: Aug. 19, 2014

(54) SYSTEM AND METHOD FOR ESTIMATING INK USAGE IN AN INKJET PRINTER

(71) Applicant: Xerox Corporation, Norwalk, CT (US)

(72) Inventors: David A. Mantell, Rochester, NY (US); David J. Metcalfe, Marion, NY (US); Martin L. Frachioni, Rochester, NY (US); Raymond J. Clark, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 11 days.

(21) Appl. No.: 13/754,262

(22) Filed: Jan. 30, 2013

(51) Int. Cl.
*B41J 29/393* (2006.01)
*B41J 2/125* (2006.01)

(52) U.S. Cl.
CPC ..... *B41J 2/125* (2013.01)
USPC ..... 347/19

(58) Field of Classification Search
CPC .... B41J 29/393; B41J 2/17546; B41J 2/2135; B41J 2/04541; B41J 2/04548
See application file for complete search history.

(56) References Cited

U.S. PATENT DOCUMENTS

| | | | | |
|---|---|---|---|---|
| 5,347,374 | A | 9/1994 | Fuss et al. | |
| 5,349,377 | A | 9/1994 | Gilliland et al. | |
| 5,434,672 | A | 7/1995 | McGuire | |
| 5,521,620 | A | 5/1996 | Becerra et al. | |
| 5,714,989 | A | 2/1998 | Wade | |
| 5,777,656 | A | 7/1998 | Henderson | |
| 5,847,724 | A | 12/1998 | Mantell | |
| 5,975,690 | A | 11/1999 | Grellmann et al. | |
| 6,334,658 | B1 | 1/2002 | Suzuki | |
| 6,543,867 | B1 | 4/2003 | Jones | |
| 6,801,731 | B2 | 10/2004 | Parker | |
| 6,806,980 | B2 | 10/2004 | Xu et al. | |
| 7,023,578 | B2 | 4/2006 | Hayes et al. | |
| 7,280,258 | B2 * | 10/2007 | Kitahara et al. | 358/501 |
| 7,286,782 | B2 | 10/2007 | Nomura et al. | |
| 7,591,550 | B2 | 9/2009 | Buehler et al. | |
| 7,597,418 | B2 | 10/2009 | Mantell et al. | |
| 2002/0165833 | A1 | 11/2002 | Minowa et al. | |
| 2003/0146945 | A1 | 8/2003 | Inui et al. | |
| 2003/0202064 | A1 | 10/2003 | Jones et al. | |
| 2006/0098251 | A1 | 5/2006 | Eklund et al. | |
| 2006/0285134 | A1 | 12/2006 | Viturro et al. | |

FOREIGN PATENT DOCUMENTS

| | | |
|---|---|---|
| JP | 10081023 | 3/1998 |

* cited by examiner

*Primary Examiner* — Lisa M Solomon
(74) *Attorney, Agent, or Firm* — Maginot, Moore & Beck, LLP

(57) ABSTRACT

An inkjet printer estimates ink usage in the printer with reference to image pixels and a history of inkjet firing for each inkjet. The printer includes an apparatus that generates an ink mass for each image pixel with reference to the image pixel and a predetermined number of previously ejected image pixels and identifies a total ink mass measurement for a printhead with reference to the ink masses generated for the image pixels of an image to be printed by the inkjet printer.

15 Claims, 3 Drawing Sheets

SYSTEM AND METHOD FOR ESTIMATING INK USAGE IN AN INKJET PRINTER

TECHNICAL FIELD

This disclosure relates generally to printers that produce images with one or more colorants on media and, more particularly, to inkjet printers that eject one or more colors of ink onto an image receiving surface to form an image.

BACKGROUND

Drop on demand inkjet technology for producing printed media has been employed in commercial products such as printers, plotters, and facsimile machines. Generally, an inkjet image is formed by selectively ejecting ink drops from a plurality of inkjets, which are arranged in one or more printheads, onto an image receiving surface. In an indirect inkjet printer, the printheads eject ink drops onto the surface of an intermediate image receiving member, such as a rotating imaging drum or belt, and the image is later transferred and fixed to the media. In direct to media printers, the printheads eject ink drops directly onto the media and the image is later fixed to the media. In both types of printers, the printer forms an image by generating and delivering firing signals to printheads that operate the inkjet ejectors within the printheads. These firing signals are generated with reference to digital image data. The operation of the inkjet ejectors expels individual ink drops from the inkjets that land at particular locations on the image receiving member. The locations where the ink drops land are sometimes called "ink drop locations," "ink drop positions," or "pixels." Thus, a printing operation can be viewed as the placement of ink drops on an image receiving member in accordance with image data.

During printing, the printheads and the image receiving surface move relative to one other and the inkjets eject ink drops at appropriate times to form an ink image on the image receiving surface. The ink ejected from the inkjets can be liquid ink, such as aqueous, solvent, oil based, UV curable ink or the like, which is stored in containers installed in the printer. Alternatively, some inkjet printers use phase change inks that are loaded in a solid form and delivered to a melting device. The melting device heats and melts the phase change ink from the solid phase to a liquid that is supplied to a printhead for printing as liquid drops onto the image receiving surface.

Operating the inkjets in the printheads at different frequencies causes the inkjets to eject ink drops of different masses. During printer manufacture, printheads are set up, through modifications of firing voltages and waveforms, to produce a default drop mass at the maximum rate of operation of the printhead. Because the mass of ink drops varies considerably with frequency at lower rates of operation, printheads may also be setup in the factory to eject drops at a lesser predetermined mass when the inkjets are operated to form a 25% pattern, which activates the inkjet ejectors at a rate that is one-quarter of the maximum frequency of the printhead. Although these calibrations help attenuate image quality issues occurring from widely different ink masses being ejected at different frequency rates, differences still occur because the data used to generate the firing signals operate inkjet ejectors at non-periodic rates. While these differences have no appreciable effects on image quality, they do affect the accuracy of ink usage estimation schemes implemented in printers.

Estimating ink usage is important to printer users so they can determine the costs of printer operation and schedule their supply purchases. Typically, a controller in a printer is programmed to estimate ink usage with reference to some usage model based on the colors in the original images produced by the printer. Some estimating programs process the contone image data, while others count the number of drops ejected by the printheads. As noted above, the rate of operation of an inkjet affects the mass of ink drops ejected by the inkjet. Estimating or accurately measuring the amount of ink used to produce a print job enables a printer to allocate appropriately the cost of the ink used to produce the print job for customers. Thus, ink usage estimates would be improved by taking the variations in ejected ink drop masses into account.

SUMMARY

In one embodiment, a method of estimating ink usage in an inkjet printer uses an inkjet firing history to update the estimated ink usage. The method includes generating an ink usage measurement for an image pixel with reference to the image pixel and to a predetermined number of image pixels previously ejected by an inkjet that ejects the image pixel for which the ink usage measurement is being generated, identifying a total ink usage measurement for a printhead with reference to the ink usage measurements generated for each inkjet in the printhead, and identifying a cost for a print job with reference to the total ink usage measurement accumulated for the printhead.

In another embodiment, an apparatus implements this method that uses an inkjet firing history to estimate ink usage in a printer. This apparatus includes a memory in which image pixels are stored, an ink usage measurement generator configured to generate an ink usage measurement for an image pixel stored in the memory with reference to the image pixel and to a predetermined number of image pixels previously ejected by an inkjet that ejects the image pixel for which the ink usage measurement is being generated, the ink usage measurement generator being further configured to identify a total ink usage measurement for a printhead with reference to the ink usage measurements generated for each inkjet in the printhead, and a controller that is configured to identify a cost for a print job with reference to the total ink usage measurement accumulated for the printhead.

BRIEF DESCRIPTION OF THE DRAWINGS

The foregoing aspects and other features of a printer that better estimates ink usage are explained in the following description, taken in connection with the accompanying drawings.

DETAILED DESCRIPTION

Figure 1:
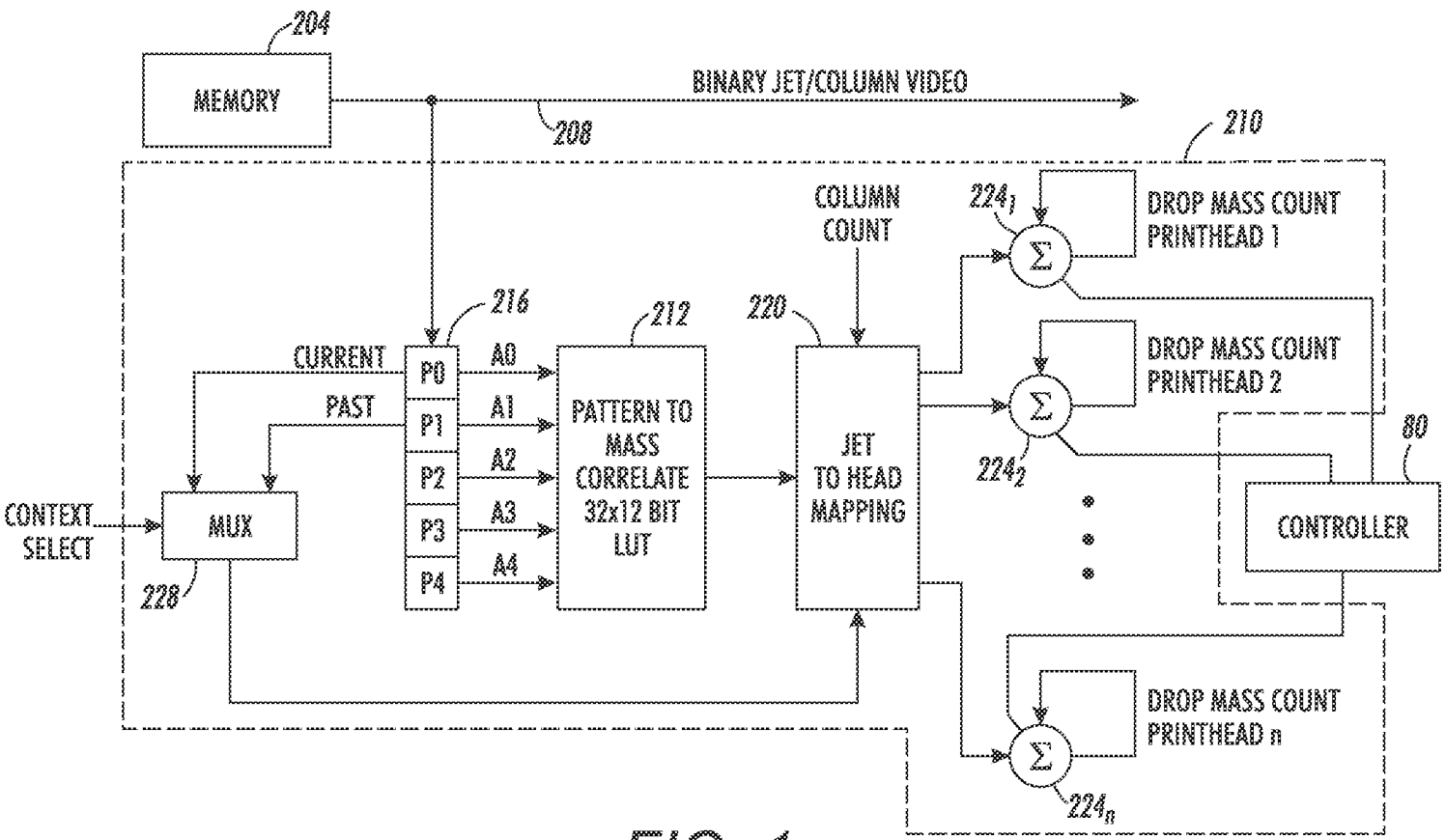
FIG. 1 is a block diagram of a circuit that enables an ink usage estimate to be generated that accounts for variations in ink drop masses with reference to a firing signal history for an inkjet.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, or the like. In the description below, an ink image is formed on a surface of an image receiving member and then transferred to media that passes through a nip formed with the image receiving member. In other embodiments, the ink image can be formed directed on the media. Consequently, "surface of an image receiving member" in this document refers to any surface that receives ink to form an ink image thereon.

As used herein, the term "process direction" refers to a direction of movement of an image receiving surface, such as an imaging drum or paper sheet, through a printer or of a printhead within a printer during an imaging operation. In some printers, the image receiving surface moves past one or more printheads in a print zone in the process direction as the printheads eject ink drops onto the image receiving surface to form images, while in other printers, the printheads eject ink as they move relative to a stationary image receiving surface to form ink images. The images formed by the ejected ink may be two or three dimensional. As used herein, the term "cross-process direction" refers to a direction that is perpendicular to the process direction in the plane of the process direction. The inkjets in a printhead and multiple printheads in a print zone are arranged in the cross-process direction to form printed images on the image receiving surface. The printer described below ejects ink drops with reference to image data that are depicted in a two-dimensional array corresponding to the process direction and cross-process direction, although the system and method described in this document may also be used in printers that form three dimensional images. Also, the system and method described in this document may also be used in printers in which the printheads, rather than the image receiving surface, move to enable formation of an image on the image receiving surface.

As used herein, the term "pixel" refers to a single value in a two-dimensional arrangement of image data corresponding to an ink image that an inkjet printer forms on an image receiving surface. The locations of pixels in the image data correspond to locations of ink drops on the image receiving surface that form the ink image when multiple inkjets in the printer eject ink drops with reference to the image data. An "activated pixel" refers to a pixel in the image data wherein the printer ejects a drop of ink onto an image receiving surface location corresponding to the activated pixel. A "deactivated pixel" refers to a pixel in the image data having a value where the printer does not eject a drop of ink onto an image receiving surface location corresponding to the deactivated pixel. The term "binary image data" refers to image data formed as a two-dimensional arrangement of activated and deactivated pixels. Each pixel in the binary image data in the embodiments described below has one of two values indicating that the pixel is either activated or deactivated, although the pixels can include multiple bits and have more than two values in other embodiments. An inkjet printer forms ink images by selectively ejecting ink drops corresponding to the activated pixels in the image data. A multicolor printer ejects ink drops of different ink color with reference to separate sets of binary image data for each of the different colors to form multicolor ink images.

As used herein, the terms "image density" and "pixel density" are used interchangeably and refer to the proportion of activated pixels within a given region of image data. The image density can be expressed as a percentage value. For example, if an arrangement of one hundred pixels includes thirty five activated pixels and sixty five deactivated pixels, then the overall image density of the arrangement is thirty five percent.

Figure 3:
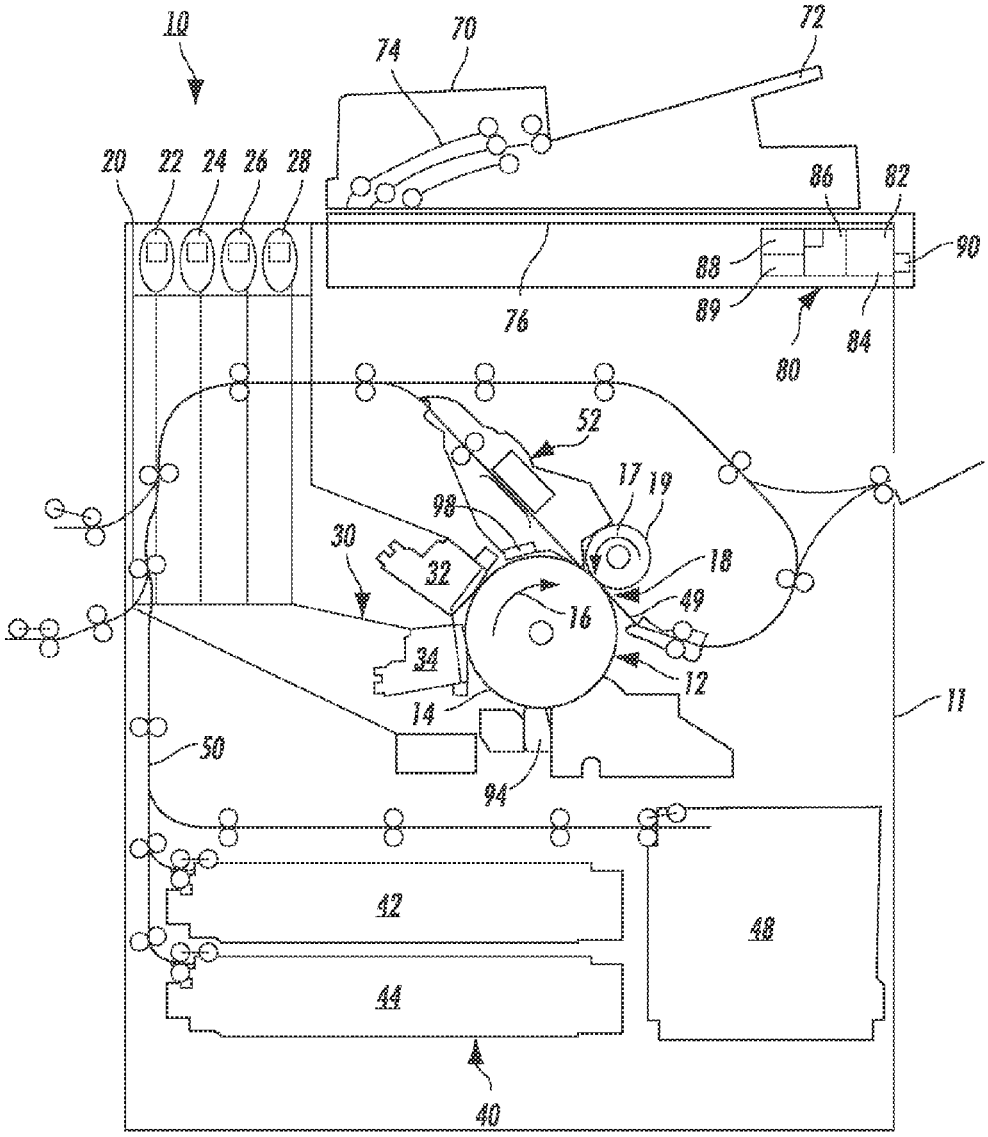
FIG. 3 PRIOR ART
FIG. 3 is a schematic diagram of a prior art printer 10 that can be configured to compensate for one or more inoperable inkjets.

FIG. 3 depicts an embodiment of a prior art printer 10 that can be configured to use inkjet firing histories to estimate ink usage in the printer. As illustrated, the printer 10 includes a frame 11 to which is mounted directly or indirectly all its operating subsystems and components, as described below. The phase change ink printer 10 includes an image receiving member 12 that is shown in the form of a rotatable imaging drum, but can equally be in the form of a supported endless belt. The image receiving member 12 includes an image receiving surface 14, which provides a surface for formation of ink images. An actuator 94, such as a servo or electric motor, engages the image receiving member 12 and is configured to rotate the image receiving member in direction 16. A transfix roller 19 rotatable in the direction 17 loads against the image receiving surface 14 of the image receiving member 12 to form a transfix nip 18 within which ink images formed on the surface 14 are transfixed onto a heated print medium 49.

The phase change ink printer 10 also includes a phase change ink delivery subsystem 20 that has multiple sources of different color phase change inks in solid form. Since the phase change ink printer 10 is a multicolor printer, the ink delivery subsystem 20 includes four (4) sources 22, 24, 26, 28, representing four (4) different colors CMYK (cyan, magenta, yellow, and black) of phase change inks. Although printer 10 is described as having four colors of ink, fewer or greater number of inks, may be supplied in a printer for generation of ink images. The phase change ink delivery subsystem also includes a melting and control apparatus (not shown) for melting or phase changing the solid form of the phase change ink into a liquid form. Each of the ink sources 22, 24, 26, and 28 includes a reservoir used to supply the melted ink to the printhead assemblies 32 and 34. In the example of FIG. 3, both of the printhead assemblies 32 and 34 receive the melted CMYK ink from the ink sources 22-28. In another embodiment, the printhead assemblies 32 and 34 are each configured to print a subset of the CMYK ink colors.

The phase change ink printer 10 includes a substrate supply and handling subsystem 40. The substrate supply and handling subsystem 40, for example, includes sheet or substrate supply sources 42, 44, 48, of which supply source 48, for example, is a high capacity paper supply or feeder for storing and supplying image receiving substrates in the form of a cut sheet print medium 49. The phase change ink printer 10 as shown also includes an original document feeder 70 that has a document holding tray 72, document sheet feeding and retrieval devices 74, and a document exposure and scanning subsystem 76. A media transport path 50 extracts print media, such as individually cut media sheets, from the substrate supply and handling system 40 and moves the print media in a process direction P. The media transport path 50 passes the print medium 49 through a substrate heater or pre-heater assembly 52, which heats the print medium 49 prior to transfixing an ink image to the print medium 49 in the transfix nip 18.

Media sources 42, 44, 48 provide image receiving substrates that pass through media transport path 50 to arrive at transfix nip 18 formed between the image receiving member 12 and transfix roller 19 in timed registration with the ink image formed on the image receiving surface 14. As the ink image and media travel through the nip, the ink image is transferred from the surface 14 and fixedly fused to the print medium 49 within the transfix nip 18. In a configuration that produces duplex prints, the media transport path 50 passes the print medium 49 through the transfix nip 18 a second time for transfixing of a second ink image to a second side of the print medium 49.

Operation and control of the various subsystems, components and functions of the printer 10 are performed with the aid of a controller or electronic subsystem (ESS) 80. The ESS or controller 80, for example, is a self-contained, dedicated mini-computer having a central processor unit (CPU) 82 with a digital memory 84, and a display or user interface (UI) 86. The ESS or controller 80, for example, includes a sensor input and control circuit 88 as well as an ink drop placement and control circuit 89. In one embodiment, the ink drop placement control circuit 89 is implemented as a field programmable gate array (FPGA). In addition, the CPU 82 reads, captures, prepares and manages the image data flow associated with print jobs received from image input sources, such as the scanning system 76, or an online or a work station connection 90. As such, the ESS or controller 80 is the main multi-tasking processor for operating and controlling all of the other printer subsystems and functions.

The controller 80 can be implemented with general or specialized programmable processors that execute programmed instructions, for example, printhead operation. The instructions and data required to perform the programmed functions are stored in the memory 84 that is associated with the processors or controllers. The processors, their memories, and interface circuitry configure the printer 10 to form ink images, and, more particularly, to control the operation of inkjets in the printhead modules 32 and 34 to compensate for inoperable inkjets. These components are provided on a printed circuit card or provided as a circuit in an application specific integrated circuit (ASIC). Each of the circuits can be implemented with a separate processor or multiple circuits are implemented on the same processor. In alternative configurations, the circuits are implemented with discrete components or circuits provided in very large scale integration (VLSI) circuits. Also, the circuits described herein can be implemented with a combination of processors, FPGAs, ASICs, or discrete components.

In operation, the printer 10 ejects a plurality of ink drops from inkjets in the printhead assemblies 32 and 34 onto the surface 14 of the image receiving member 12. The controller 80 generates electrical firing signals to operate individual inkjets in one or both of the printhead assemblies 32 and 34. In the multi-color printer 10, the controller 80 processes digital image data corresponding to one or more printed pages in a print job, and the controller 80 generates two dimensional bit maps for each color of ink in the image, such as the CMYK colors. Each bit map includes a two dimensional arrangement of pixels corresponding to locations on the image receiving member 12. In some versions of the printer shown in FIG. 3, the bit map is strictly binary, which means each pixel has one of two values indicating if the pixel is either activated or deactivated. In other versions, each pixel in the bit map can have values greater than 1 to indicate the inkjet is operated multiple times to form the pixel. The controller 80 generates a firing signal to activate an inkjet and eject a drop of ink onto the image receiving member 12 for the activated pixels, but does not generate a firing signal for the deactivated pixels. The combined bit maps for each of the colors of ink in the printer 10 generate multicolor or monochrome images that are subsequently transfixed to the print medium 49. The controller 80 generates the bit maps with selected activated pixel locations to enable the printer 10 to produce multi-color images, half-toned images, dithered images, and the like.

The printer 10 is an illustrative embodiment of a printer that can be modified to use inkjet firing histories to estimate ink usage in the printer, but the processes described below can be implemented in alternative inkjet printer configurations. For example, while the printer 10 depicted in FIG. 3 is configured to eject drops of a phase change ink, alternative printer configurations that form ink images using different ink types including aqueous ink, solvent based ink, UV curable ink, and the like can be operated using the processes described below. Additionally, while printer 10 is an indirect printer, printers that eject ink drops directly onto a print medium can be operated using the processes described below. In fact, any printer ejecting ink drops with reference to image data can be implemented with the hardware and/or software necessary to perform the processes described below to estimate more accurately the amount of ink ejected to produce a print job.

An apparatus that identifies ink mass usage in a printing system is shown in FIG. 1. The apparatus includes a memory 204, a buffer 216, a pattern converter 212, and a mapping gate 220. Image pixels corresponding to an image to be printed are stored in the memory 204. The image pixels identify the activated and non-activated inkjets used to form the image corresponding to the image pixels. In some embodiments, the image pixel data is binary to enable each pixel to be represented by a single bit. In these embodiments, the bit being "on" indicates the corresponding inkjet is operated to eject an ink drop and the bit being "off" indicates the inkjet is not operated to eject an ink drop. In other embodiments, each image pixel can be represented by multiple bits. Values of an image pixel that are greater than "one" indicate the corresponding inkjet is operated the corresponding number of times to form the pixel in the ink image. For example, a value of three indicates the inkjet is operated three times at the maximum inkjet frequency to form the pixel. In some embodiments, image data for a color separation can be down sampled to produce a low resolution version of the image for processing by the apparatus. Low resolution versions are used to increase the speed of processing an image with some loss of ink mass accuracy.

In one embodiment, the image pixels are read out of the memory one pixel at a time by column. Other embodiments can process the image pixels in other orders. For example, image pixels for multiple inkjets can be processed concurrently and independently of one another. In another example, the image pixels can be processed in a row-by-row manner or rows can be processed concurrently. In the embodiment processing the image pixels one column at a time, the activated and non-activated pixels for one inkjet are read out before the image pixels for another inkjet are read out. The image pixels produce a serial stream 208 that is processed by an ink usage measurement generator 210. The ink usage measurement generator 210 includes a pattern converter 212, a serial buffer 216, a mapping gate 220, and a plurality of accumulating devices $\mathbf{224}_1$ to $\mathbf{224}_n$. Each accumulating device identifies an ink usage measurement for one printhead in the printer. As used in this document, "device" refers to any combination of electronic components, including programmed instructions stored in a memory that are executed by a processor, mechanical components, or both electronic and mechanical components that are operated to perform a function or achieve a purpose. The pattern converter 212 identifies a pattern formed by a predetermined number of image pixels stored in the serial buffer 216. The image pixels in the serial buffer 216 include the image pixel for which an ink usage measurement is being generated and the image pixels that were previously printed by the same inkjet so the pattern corresponds to a history of firings for the inkjet. For example in FIG. 1, the pattern converter processes a five bit pattern stored in buffer 216 since the memory 204 in this embodiment stores one bit image pixels. In other embodiments, each image pixel in the serial buffer 216 can be represented with multiple bits of data. The most recently received image pixel represents whether and/or the number of times the inkjet is operated with reference to the current image pixel to eject an ink drop and the remaining image pixels in the pattern indicate the previous operations of the inkjet with reference to the order of the image pixels in the pattern. In the one bit per image pixel embodiment, a "1" bit indicates an inkjet firing and a "0" bit indicates an inkjet not firing.

The pattern stored in the buffer 216 is delivered to the converter 212 for generation of an estimated ink mass for the ink drop corresponding to the image pixel most recently received with the firing history for the same inkjet being represented by the other image pixels stored in the buffer. In the embodiment shown in FIG. 1, the pattern in the buffer 216 is an address into a lookup table (LUT), which implements the converter 212. The data stored at the location in the LUT corresponding to the pattern indicates the mass of the ink drop ejected by the inkjet that has been operated in the manner corresponding to the image pixels in the pattern. Thus, the converter 212 converts the firing signal history in the buffer 216 into a corresponding ink drop mass for the current image pixel. This ink drop mass is output by the converter 212 and directed by the mapping gate 220 to the accumulating device for a printhead having the inkjet that is operated with reference to the image pixels in the serial buffer. As shown in FIG. 1, the ink drop mass is added to the ink drop masses previously accumulated for the printhead to produce an ink usage measurement for the printhead. The embodiment in FIG. 1 passes the ink drop masses to the mapping gate 220 that is selectively connected to one of the accumulating devices $\mathbf{224}_1$, $\mathbf{224}_2$, . . . $\mathbf{224}_n$. Each accumulating device corresponds to a printhead in the printing system. A count of the current column, which corresponds to an inkjet in one of the printheads for the embodiment shown in FIG. 1, directs the output of the converter 212 to the accumulating device for the corresponding printhead and the accumulating device generates an ink usage measurement for the printhead by adding the ink drop mass output by the converter 212 to a current sum for the printhead that is maintained by the corresponding accumulating device. In one embodiment, each printhead has 880 inkjets. For column counts 1 to 880, the ink drop mass values are directed to the accumulating device for the first printhead. For the next 880 columns, the ink drop mass values are directed to the accumulating device for the second printhead. This process continues for all of the printheads in the printing system and then the next image is processed beginning with the first printhead. In the embodiment shown in FIG. 1, the gate 220 is also connected to a multiplexer 228 that receives the two most recent image pixels from the serial stream. If either one or both of those bits is a "1," then the gate is enabled to pass the ink drop mass to the accumulating device for the printhead corresponding to the column count. Otherwise, the ink drop mass in the gate is not sent to one of the accumulating devices.

Figure 2:
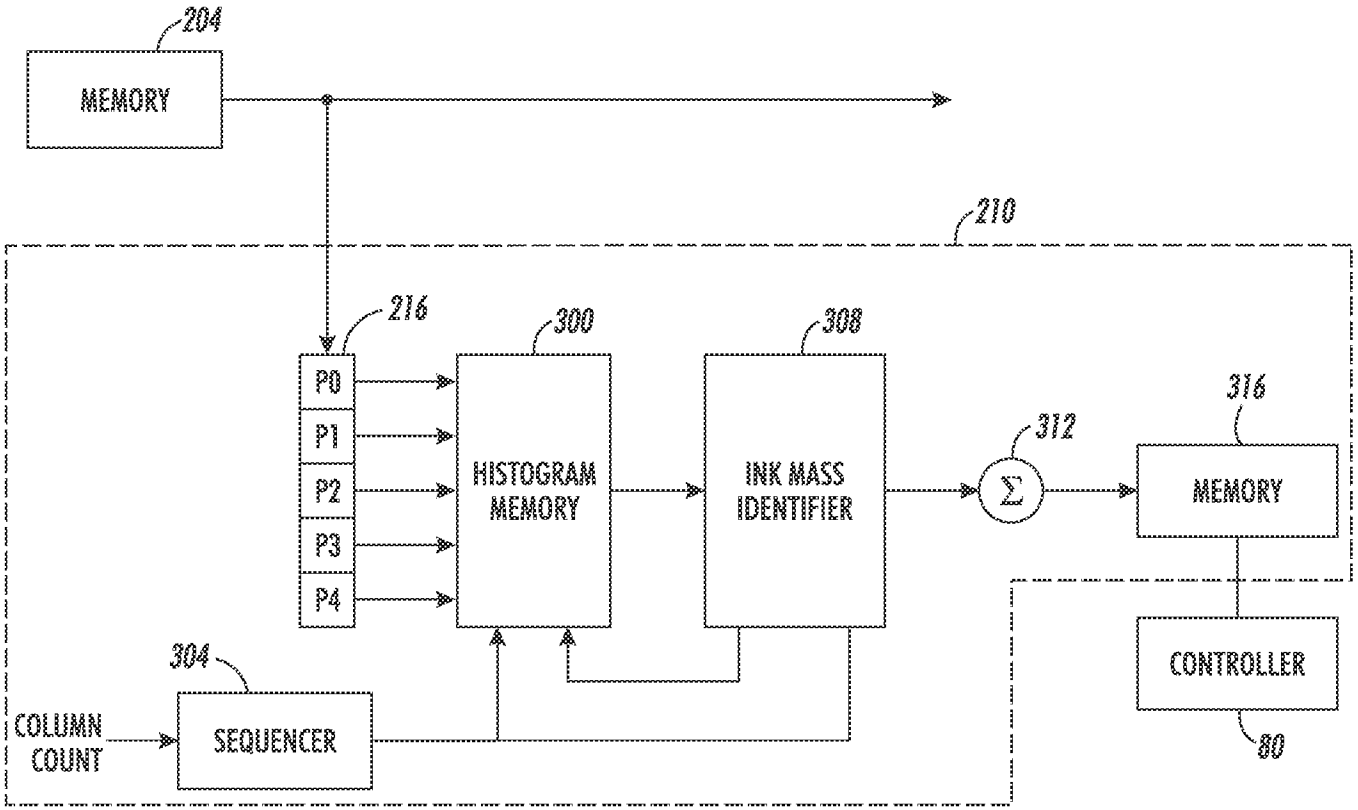
FIG. 2 is a block diagram of an alternative embodiment of a circuit that enables an ink usage estimate to be generated that accounts for variations in ink drop masses with reference to a firing signal history for an inkjet.

In an alternative embodiment shown in FIG. 2, a memory 300 is configured with a predetermined number of storage locations that correspond to the permutations for the states for the predetermined number of image pixels processed by the ink usage measurement generator. That is, each image pixel has a number of states that corresponds to the number of bits and the range of values for each bit used to represent each image pixel. Each storage location in the memory 300 has an address corresponding to one possible permutation of the image pixel states that can be stored in the buffer. As the most recent image pixel is received from the bit stream, a count kept at the storage location in the memory 300 that corresponds to the permutation stored in the serial buffer 216 is incremented. When the column count for the embodiment shown in FIG. 2 indicates that all of the columns for a printhead have been processed, a sequencer 304 generates a signal to the memory, which causes the memory to output the count stored at a first storage location to an ink mass identifier 308. The ink mass identifier 308 generates an ink mass measurement that corresponds to the number of times the permutation stored in the first storage location in memory 300 occurred. In one embodiment, the ink mass identifier identifies the ink mass for a permutation by multiplying the count stored at a storage location by an ink mass estimate associated with the address of the storage location. The product is provided to an accumulating device 312, which accumulates a total ink usage measurement for a printer. In the embodiment being described, the accumulating device 312 adds the product produced by the ink mass identifier 308 to an accumulated sum stored in the accumulating device 312 for a printhead. The ink mass identifier 308 then generates a signal to the histogram memory 308 to enable the sequencer to strobe the memory 300 for the count kept in the next storage location. This process continues until the counts at all of the locations in the memory 308 have been provided to the ink mass identifier 308 and all of the ink masses corresponding to the permutations that were processed have been accumulated to generate the estimated ejected ink mass for a printhead. This mass is then stored in a memory 316. The counts in the memory 308 are then re-initialized to zero, the accumulated total mass in the accumulating device is reset to zero, and the image pixel positions in the buffer 216 are reset to zero. In effect, this alternative embodiment produces a histogram for each possible permutation of the image pixel states for the predetermined number of image pixels and the total number of occurrences for each permutation is multiplied by the ink mass corresponding to each permutation to identify the ink mass ejected by the inkjets responding to the image pixel permutation. These products are summed to identify the total ink mass ejected by a printhead for an image.

The embodiments of the ink usage measurement generator 210 described above can be implemented with general or specialized programmable processors that execute programmed instructions to estimate the ink usage for operating an inkjet with reference to an image pixel and the predetermined number of image pixels preceding the image pixel. The instructions and data required to perform the programmed functions are stored in a memory that is associated with the processors or controllers. The processors, their memories, and interface circuitry configure the ink usage measurement generator 210 to generate ink usage estimates. These components are provided on a printed circuit card or provided as a circuit in an application specific integrated circuit (ASIC). Each of the circuits can be implemented with a separate processor or multiple circuits are implemented on the same processor. In alternative configurations, the circuits are implemented with discrete components or circuits provided in very large scale integration (VLSI) circuits. Also, the circuits described herein can be implemented with a combination of processors, FPGAs, ASICs, or discrete components. Thus, the ink usage measurement generator 210 can be implemented in hardware alone, software executed by a processor alone, or a combination of hardware and software.

The controller 80 can be operatively connected to each accumulating device in the embodiment of FIG. 1 or the memory 316 in FIG. 2 to receive the total ink mass ejected by each printhead. The controller is configured to identify a cost for a print job with reference to the total ink usage measurement generated for each printhead in the printer. For example, the estimated ejected ink mass for all of the printheads ejecting the same color of ink can be added and this total mass used to generate a cost for the print job with reference to a cost for that color of ink per gram. This cost can be used to generate an invoice for the print job or stored later generation of an invoice covering print jobs performed over a specified period of time. In another embodiment, the total amount of ink ejected by a printhead is correlated to an expected life of the printhead and can be displayed for a maintenance worker, who can use this information to evaluate printhead replacement. As used in this document, "cost" means any measurement of printer resource usage related to ink usage in the printer. For example, the ink ejected by a printhead can be multiplied by a price per unit parameter to generate a charge to a customer using the printer. Because the system and method above identifies total ink ejected on a printhead basis, different colors of ink could be charged at different rates. Other printer resources can be correlated to ink usage in the printer as well.

In the description above, processing of the image data is done serially in column-major order. In other embodiments, columns of pixels are processed concurrently, or are processed concurrently by blocks and serially by blocks. In other embodiments, the pixels are processed in row-major order. In the system and method described above, the mass of a pixel is identified not only with reference to the pixel value, but also with reference to the values of pixels in area surrounding the pixel. Thus, the pixel pattern in the context of a pixel selects or drives identification of the mass of the pixel being processed. Therefore, the sequence in which pixels are processed is immaterial. Furthermore, each pixel in the embodiment above has a number of states. Consequently, the number of states per pixel and the number of pixels provide a number of permutations for a pixel context. That is, for a group of pixels defining a pixel context, each pixel has a possible number of states so a calculable number of permutations exists for the context. Each permutation identifies a number, which is a mass stored in the memory. Thus, the present system and method can be used to identify ink usage masses in printers having image data pixels that have more than two states per pixel.

It will be appreciated that various of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An apparatus for estimating ink mass usage in a printing system comprising:

a memory in which image pixels are stored;

an ink usage measurement generator configured to generate an ink usage measurement for an image pixel stored in the memory with reference to the image pixel and to a predetermined number of image pixels previously ejected by an inkjet that ejects the image pixel for which the ink usage measurement is being generated, and to identify a total ink usage measurement for a printhead with reference to the ink usage measurements generated for each inkjet in the printhead, the ink usage measurement generator having a pattern converter that identifies a pattern for the image pixel and the predetermined number of previously ejected image pixels and that generates an estimated ejected ink mass with reference to each pattern identified by the pattern converter; and a controller that is configured to identify a cost for a print job with reference to the total ink usage measurement accumulated for the printhead.

2. The apparatus of claim 1 wherein the image pixels correspond to activated and non-activated inkjets operated to form an image with the printing system.

3. An apparatus for estimating ink mass usage in a printing system comprising:

a memory in which image pixels that correspond to a low resolution image of an image to be printed by the printing system are stored;

an ink usage measurement generator configured to generate an ink usage measurement for an image pixel stored in the memory with reference to the image pixel and a predetermined number of image pixels previously ejected by an inkjet that ejects the image pixel for which the ink usage measurement is being generated, the ink usage measurement generator being further configured to identify a total ink usage measurement for a printhead with reference to the ink usage measurements generated for each inkjet in the printhead; and a controller that is configured to identify a cost for a print job with reference to the total ink usage measurement accumulated for the printhead.

4. The apparatus of claim 1, the memory further comprising:

a serial buffer through which the image pixels are shifted, the serial buffer being operatively connected to the pattern converter.

5. An apparatus for estimating ink mass usage in a printing system comprising:

a memory in which image pixels are stored;

an ink usage measurement generator being configured to generate an ink usage measurement for an image pixel stored in the memory with reference to the image pixel and to a predetermined number of image pixels previously ejected by an inkjet that ejects the image pixel for which the ink usage measurement is being generated, and to identify a total ink usage measurement for a printhead with reference to the ink usage measurements generated for each inkjet in the printhead, the ink usage measurement generators including:

a serial buffer operatively connected to the memory to receive image pixels and shift the image pixels through the serial buffer, the serial buffer being configured to store the predetermined number of image pixels;

a lookup memory having an address space that corresponds to the predetermined number of image pixels in the serial buffer, the lookup memory being configured to output an ink mass estimate from an address in the address space that corresponds to the image pixels stored in the serial buffer; and a device configured to identify the ink mass estimates output by the lookup memory to generate the total ink mass measurement for the printhead; and a controller that is configured to identify a cost for a print job with reference to the total ink usage measurement accumulated for the printhead.

6. The apparatus of claim 5, the device being operatively coupled to one of a most significant and a least significant image pixel in the serial buffer and the device being further configured to identify the ink mass estimate output by the lookup memory to generate the total ink mass measurement for the printhead only in response to the one of the most significant and the least significant image pixel in the serial buffer indicating at least one ink drop is ejected by the printhead with reference to image pixel for which the ink usage measurement is being generated.

7. The apparatus of claim 1, the pattern converter further comprising:

a memory having a predetermined number of storage locations, each storage location having an address corresponding to one permutation of possible states for the predetermined number of image pixels stored in the serial buffer and each storage location being associated with an estimated ink mass corresponding to the address of the storage location, the pattern converter being further configured to increment a count stored at one of storage locations in the memory of the converter in response to a permutation corresponding to the address of the storage location being detected;

an ink mass identifier that is operatively connected to the memory to receive counts from the memory, the ink mass identifier being configured to generate an ink mass for each permutation stored in the memory with reference to the count stored at each storage location in the memory of the converter and the ink mass estimate associated with the address of each storage location; and a device operatively connected to the ink mass identifier to receive the ink masses generated by the ink mass identifier and generate the total ink usage measurement for the printhead.

8. The apparatus of claim 1, the printing system further comprising:

a plurality of printheads;

the ink usage measurement generator being further configured to generate a total ink mass measurement for each printhead in the printing system; and the controller being further configured to identify a cost for a print job with reference to the total ink usage measurement generated for each printhead.

9. A method for estimating ink mass usage in a printing system comprising:

generating contone image pixels with reference to image pixels of an image to be printed by the printing system;

identifying a pattern of image pixels for each image pixel of the image to be printed by the printing system with reference to the contone image pixels;

generating an estimated ejected ink mass with reference to all of the identified patterns;

generating an ink usage measurement for each image pixel with reference to the image pixel and to a predetermined number of image pixels previously ejected by an inkjet that ejects the image pixel for which the ink usage measurement is being generated;

identifying a total ink usage measurement for a printhead with reference to the ink usage measurements generated for each inkjet in the printhead; and identifying a cost for a print job with reference to the total ink usage measurement accumulated for the printhead.

10. A method for estimating ink mass usage in a printing system comprising:

generating image pixels that correspond to a low resolution image of an image to be printed by the printing system;

identifying a pattern of image pixels for each image pixel of the image to be printed by the printing system with reference to the low resolution image;

generating an estimated ejected ink mass with reference to all of the identified patterns;

generating an ink usage measurement for each image pixel with reference to the image pixel and to a predetermined number of image pixels previously ejected by the inkjet that ejects the image pixel for which the ink usage measurement is being generated;

identifying a total ink usage measurement for a printhead with reference to the ink usage measurements generated for each inkjet in the printhead; and identifying a cost for a print job with reference to the total ink usage measurement accumulated for the printhead.

11. The method of claim 9 further comprising:

shifting the image pixels to form a stream of image pixels.

12. The method of claim 9, the pattern identification further comprising:

shifting the image pixels through a serial buffer configured to store the image pixel and the predetermined number of image pixels;

identifying an ink mass estimate for the image pixel and the predetermined number of previously ejected image pixels in the serial buffer following a shift of the image pixels in the serial buffer; and identifying the total ink usage measurement for the printhead with reference to the identified ink mass estimates.

13. The method of claim 12, the identification of the ink mass estimates further comprising:

including an ink mass estimate in the total ink usage measurement for the printhead only in response to the one of a most significant and a least significant image pixel in the serial buffer indicating an ink drop is ejected by the printhead.

14. The method of claim 12 further comprising:

incrementing a count for one permutation for possible states for the image pixel and the predetermined number of previously ejected image pixels stored in the serial buffer in response to the permutation of the image pixel and the predetermined number of image pixels stored in the serial buffer corresponding to an address of a storage location in a memory;

generating an ink mass estimate for each permutation with reference to the count stored at each storage location in the memory and an ink mass associated with each permutation; and generating the total ink usage measurement for the printhead with reference to the ink mass estimate generated for each permutation.

15. The method of claim 9 further comprising:

identifying a total ink usage measurement for each printhead in the printing system; and identifying the cost for the print job with reference to the total ink usage measurement identified for each printhead.

* * * * *